US005248100A

United States Patent [19]

Arakawa

[11] Patent Number: 5,248,100

[45] Date of Patent: Sep. 28, 1993

[54] CRUSHER WITH ROTOR FOR SHEARING

[75] Inventor: Kazuaki Arakawa, Osaka, Japan

[73] Assignee: Kurimoto, Ltd., Osaka, Japan

[21] Appl. No.: 814,177

[22] Filed: Dec. 30, 1991

[30] Foreign Application Priority Data

Jul. 22, 1991 [JP] Japan ..... 3-206383

[51] Int. Cl.[5] ..... B02C 25/00; B02C 23/02

[52] U.S. Cl. ..... 241/34; 241/36; 241/167; 241/79; 241/236; 241/225; 241/DIG. 31; 241/DIG. 38

[58] Field of Search ..... 241/79, 36, 34, 166, 241/167, 236, 243, 224, 225, DIG. 31, DIG. 38

[56] References Cited

U.S. PATENT DOCUMENTS

| | | | |
|---|---|---|---|
| 1,339,933 | 5/1920 | Liggett | 241/225 |
| 2,275,595 | 3/1942 | Schwartz | 241/58 |
| 2,378,681 | 6/1945 | Bailey et al. | 241/60 |
| 2,473,514 | 6/1949 | Ebersole | 241/58 |
| 2,545,254 | 3/1951 | Bice | 241/61 |
| 3,337,139 | 8/1967 | Lloyd et al. | 241/79 X |
| 4,264,041 | 4/1981 | Kitto, Jr. et al. | 241/57 |
| 4,410,144 | 10/1983 | Imperi | 241/236 |
| 4,519,350 | 5/1985 | Rouse | 241/DIG. 31 X |
| 4,592,516 | 6/1986 | Tschantz | 241/79 X |
| 4,607,800 | 8/1986 | Barclay | 241/DIG. 31 X |
| 4,684,071 | 8/1987 | Dicky | 241/DIG. 31 X |
| 4,757,949 | 7/1988 | Horton | 241/DIG. 31 X |
| 4,815,667 | 3/1989 | Keller | 241/DIG. 38 X |
| 4,844,363 | 7/1989 | Garnier et al. | 241/236 X |
| 5,062,576 | 11/1991 | Burda | 241/167 |
| 5,139,205 | 8/1992 | Gallagher et al. | 241/79 X |

*Primary Examiner*—Mark Rosenbaum
*Assistant Examiner*—Frances Chin
*Attorney, Agent, or Firm*—Jones, Tullar & Cooper

[57] ABSTRACT

A rotor shearing type crusher for crushing municipal waste and industrial waste whether it is bulky or not. If any foreign material, which is impossible to crush, is mixed with the municipal waste or industrial waste, the foreign material is promptly discriminated and discharged separately. The crusher includes a casing, a feed plate and a cutter respectively rotatably mounted to the casing obliquely above two rotatable knives. The inclination of the feed plate and cutter can be changed freely. Cutouts rae provided on the top end of the feed plate and cutter in a comb-like manner to dodge cutting edges of the rotatable knives intersecting each other. A discharge port is divided into two sections. The crusher of such a construction performs a function of tearing off soft waste twining itself around the rotatable knives. Rigid material impossible to be crushed is separately discharged. Even dangerous small waste such as cartridges, cylinders, etc. can be crushed and degassed inside without fail. Bulky material is pushed and crushed and bitten into. As a result of such a construction, advantages such as less machine trouble, high productivity and long life of the rotatable knives are assured.

9 Claims, 12 Drawing Sheets

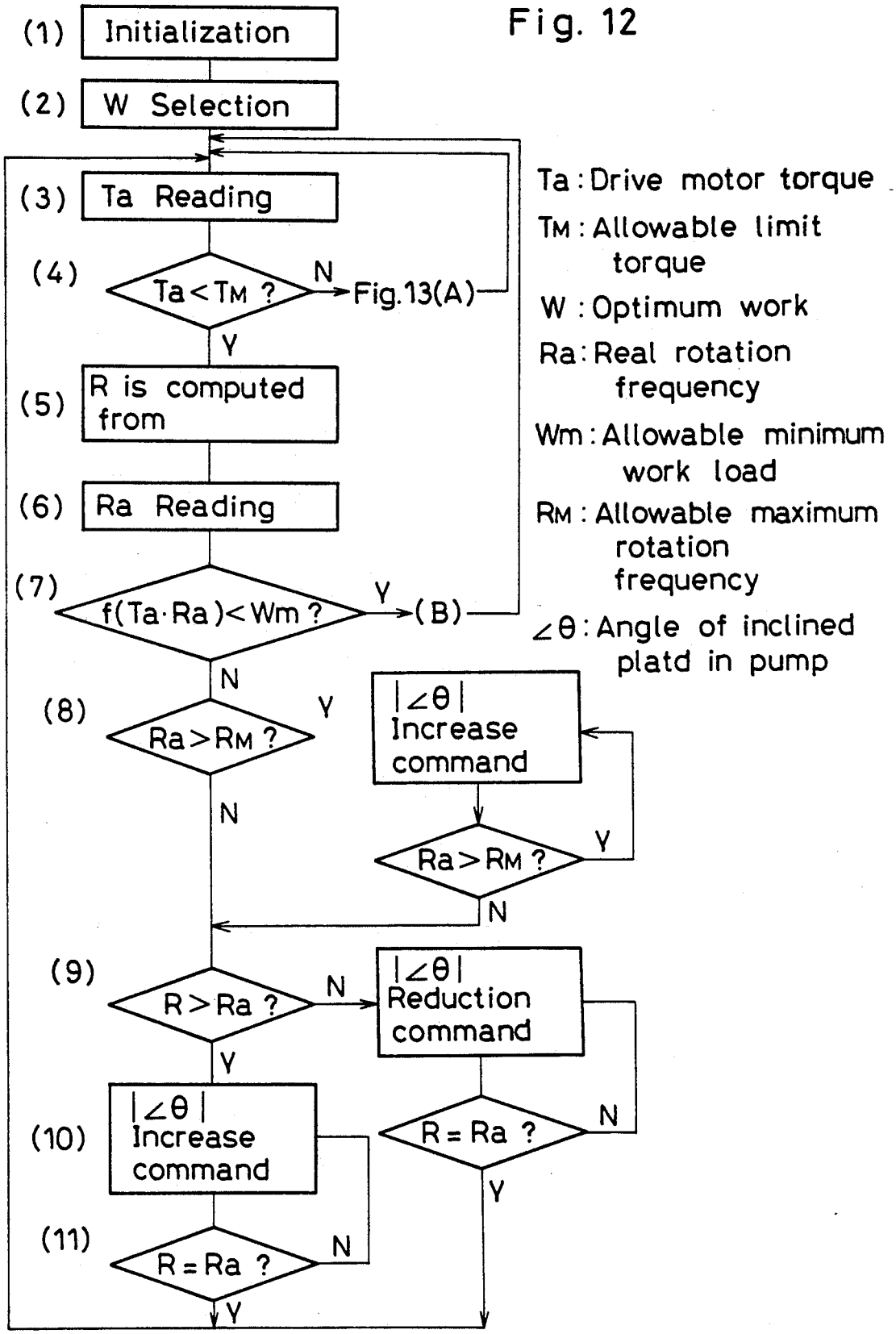
Fig. 12
(1) Initialization
(2) W Selection
(3) Ta Reading
(4) Ta<TM ?
N
Fig.13(A)
Y
(5) R is computed from
(6) Ra Reading
(7) f(Ta·Ra)<Wm ?
Y
(B)
N
(8) Ra>RM ?
Y
|∠θ| Increase command
Ra>RM ?
Y
N
N
(9) R>Ra ?
N
|∠θ| Reduction command
Y
(10) |∠θ| Increase command
R=Ra ?
N
Y
(11) R=Ra ?
N
Y
Ta : Drive motor torque
TM : Allowable limit torque
W : Optimum work
Ra : Real rotation frequency
Wm : Allowable minimum work load
RM : Allowable maximum rotation frequency
∠θ : Angle of inclined platd in pump

CRUSHER WITH ROTOR FOR SHEARING

BACKGROUND OF THE INVENTION

1. Field of the Invention

The present invention relates to a crusher with a rotor for shearing (hereinafter referred to as "rotor shearing type crusher") which shearingly shreds of crushes municipal waste (such as carpets, cartridge gas cylinders, spray type cans), bulky waste (such as refrigerators, washing machines, television sets, bicycles, rear cars, furniture, beds), industrial waste (such as scrap tires, scrap plastic), construction waste (such as concrete, asphalt, timber, paper, sheet, string, rope), or for collection of useful resources from waste.

2. Description of Prior Art

It has been heretofore well known to introduce a preliminary process of shearingly crushing municipal waste and consecutively throwing the crushed waste in an incinerator before performing an incineration disposal of the municipal waste, for the purpose of improving incineration efficiency. In this process, a rotor shearing type crusher with dual shafts is popularly known as one functionally suitable apparatus and has been put into practical use. This rotor shearing type crusher mainly comprises a housing having a hopper-shaped charge port on the upper side and a discharge port for discharging crushed waste on the bottom side; and two rotary shafts disposed almost horizontally in the housing in such a manner as to be parallel to each other and rotatably supported. These two shafts are respectively provided with rotatable knives and spacer rings in an alternate manner so that the cutting edge of one rotary knife may move pass and nearby the outer periphery of a spacer ring of the other rotary knife to bite into the waste therebetween and otherwise shear the waste between side edges of the rotary knives.

Since there are obviously different types of municipal waste to be crushed in the crusher, various problems are apt to occur, being quite different from simple shredding of things of a fixed shape. To meet this situation, several attempts have been proposed to be added to the basic construction.

For example, in the apparatus disclosed in Japanese Laid-Open Utility Model Registrations Publication (unexamined) No. 63-51650 shown in FIG. 14, the rotatable knives 23*a*, 24*a* and the spacer ring 25*a* are alternately arranged on the rotary shafts 21*a*, 22*a* so that the rotatable knife of the one shaft may move pass and nearby the spacer ring of the other shaft and the rotation frequency of the two shafts is set to be different.

In the municipal waste, thin and soft vinyl bags, strings, underwear, socks, etc. are mixed and they are apt to twine themselves around the spacer ring without being crushed, resulting in a reduction in crushing performance. This disadvantage may be overcome to a certain extent by the mentioned difference in rotation frequency because the wastes are torn off between the rotatable knives and projections, then discharged.

Another attempt is disclosed in Japanese Utility Model Registration Publication (examined) No. 2-30030, as shown in FIG. 15, to solve a problem in which waste sticks to the periphery of the drum 102, wherein the drum 102 gradually makes the crushing gap smaller, finally closing the entire gap, thereby bringing about an overload problem. To overcome this problem, it is proposed by this publication to provide an actuator on the outside of the casing 1*b* so as to turn a scraper 104 and move it close to the periphery of the drum to scrape off the waste stuck to the drum.

However, there are so many kinds of waste thrown into an incinerator for disposal and accordingly there are also varieties of physical and chemical characteristics of such waste. Therefore, a variety of problems occur even with respect to a rotor shearing type crusher for carrying out pretreatment. In view of such a situation, it may be said that means of solving the previously mentioned problems are particularly needed which smoothly and exactly carry out the pretreatment of many kinds of waste materials with a single crusher.

Though it is a recent trend to conduct collection of classified waste with respect to domestic waste and those from factories, there is actually considerable differences in bulk or volume of each waste, and it may be required to enlarge a sectional area of the waste charge port of the crusher for throwing bulky waste therein. With such a crusher having a large waste charge port, however, another problem arises in that the thrown waste may not be concentrated on the center part between two rotatable knives but centrifugally dispersed to regions such as the side of corner portions of the apparatus where no shredding or crushing operation takes place, thus it becomes very difficult to effectively perform the necessary crushing of the waste. Particularly in case of cartridge gas cylinders, spray type cans and the like, it is essential to completely degas the inside thereof beforehand because there is a possibility of explosion of residual gas at the time of delivering them to the subsequent process of high speed hammer crushing or a further process of fluidized incineration. Moreover, this possibility of explosion is increased when the abrasion of rotatable knives proceeds to the extent of enlarging the gap between the rotatable knives and the spacer rings, because relatively small containers such as cartridge gas cylinders may pass through the gap without being crushed.

On the other hand, with the progress of abrasion, such waste as tires, carpets, vinyl products, plate, string, and rope which is flexible and deformable may be bitten or drawn in along the gap and, without being crushed, the bitten wastes may stick and twine themselves to and round the two rotatable knives resulting in an idle running problem.

Furthermore, there is a further possibility of some rigid material being mixed into other waste, the rigid material being absolutely unable to be crushed between the two rotatable knives. For example, waste such as used motors or steel ingots have high rigidity, and even if an attempt is made to forcibly crush this waste by biting it between the rotatable knives, without fail an overload will be applied to the crusher resulting in serious trouble for the crusher.

When some bulky waste such as refrigerators or washing machines are longitudinally thrown in a crusher, it is sometimes the case that the bottom side of such bulky waste mounts on the rotatable knives and takes a posture of being supported thereby, and as a result the rotatable knives are obliged to merely repeat idle running and is unable to bite into the bulky waste, thus the crushing operation makes no further progress.

SUMMARY OF THE INVENTION

The present invention was therefore developed to solve the above-discussed problems and has as an object to provide a rotor shearing type crusher in which any municipal waste thrown in is guided at all times to the center portion between rotatable knives irrespective of the dimensions of the waste, and any waste of high rigidity which is impossible to be crushed can be pretreated before damaging the crusher, even when such waste is mixedly thrown in the crusher; and if the crushing efficiency declines due to abrasion of the rotatable knives, the decline is sufficiently compensated for so as to assure an endurable long time operation.

To accomplish the foregoing object, the rotor shearing type crusher in accordance with the present invention comprises: two rotary shafts the rotational direction and frequency of which are independently changeable; a pair of rotatable knives in one of which a feed plate is disposed obliquely above while a cutter is disposed obliquely above but on the opposite side, both the feed plate and cutter being independently rotatable and arranged vertically; cutouts which are provided in a comb-like manner along the full length on the top end of the feed plate and cutter, so that the top end of the rotatable knives cross each other and may in their movement pass through the cutout portions; and a discharge port which is divided into two sections by a partition therebetween beneath the rotatable knives.

In a rotor shearing type crusher of the above construction, any container having residual gas and thrown mixedly together with other municipal waste can be exactly crushed, whereby the next process is securely performed without danger of explosion. And any rigid material mixed in with the other municipal waste and impossible to be crushed can be discharged through the individual discharge port without stopping the operation of the crusher and can be separated from the waste to be delivered to the next process. Thus, considerable advantages are assured in terms of both maintenance and personnel saving.

Furthermore, the rotor shearing type crusher of the invention is advantageous in that any waste which is soft, easy to stick or twine itself around the rotatable knives and very difficult to be shredded is sufficiently sheared, and guidance to shearing crushing points any waste to be crushed and impossible to crush due to sticking or remaining on a portion of the crusher such as the upper corner of the rotatable knives is achieved. It is also possible to employ other rotatable knives of different type to compensate for largely declined crushing performance if abrasion of the current rotatable knives proceed to a certain extent. This is an advantage from an economical viewpoint assuring continuance of the crushing operation and extending the time for replacement of the rotatable knives. For example, it has been actually reported that the mentioned time for replacement was extended twice as long as the prior art.

Other objects, features and advantages of the invention will become apparent in the course of following description with reference to the accompanying drawing.

BRIEF DESCRIPTION OF THE DRAWINGS

In the drawings formings a part of the present application,

FIG. 2 (B) is also a developed view after abrasion;

FIG. 12 is a flow chart showing a normal control procedure;

DESCRIPTION OF THE PREFERRED EMBODIMENTS

Figure 1:
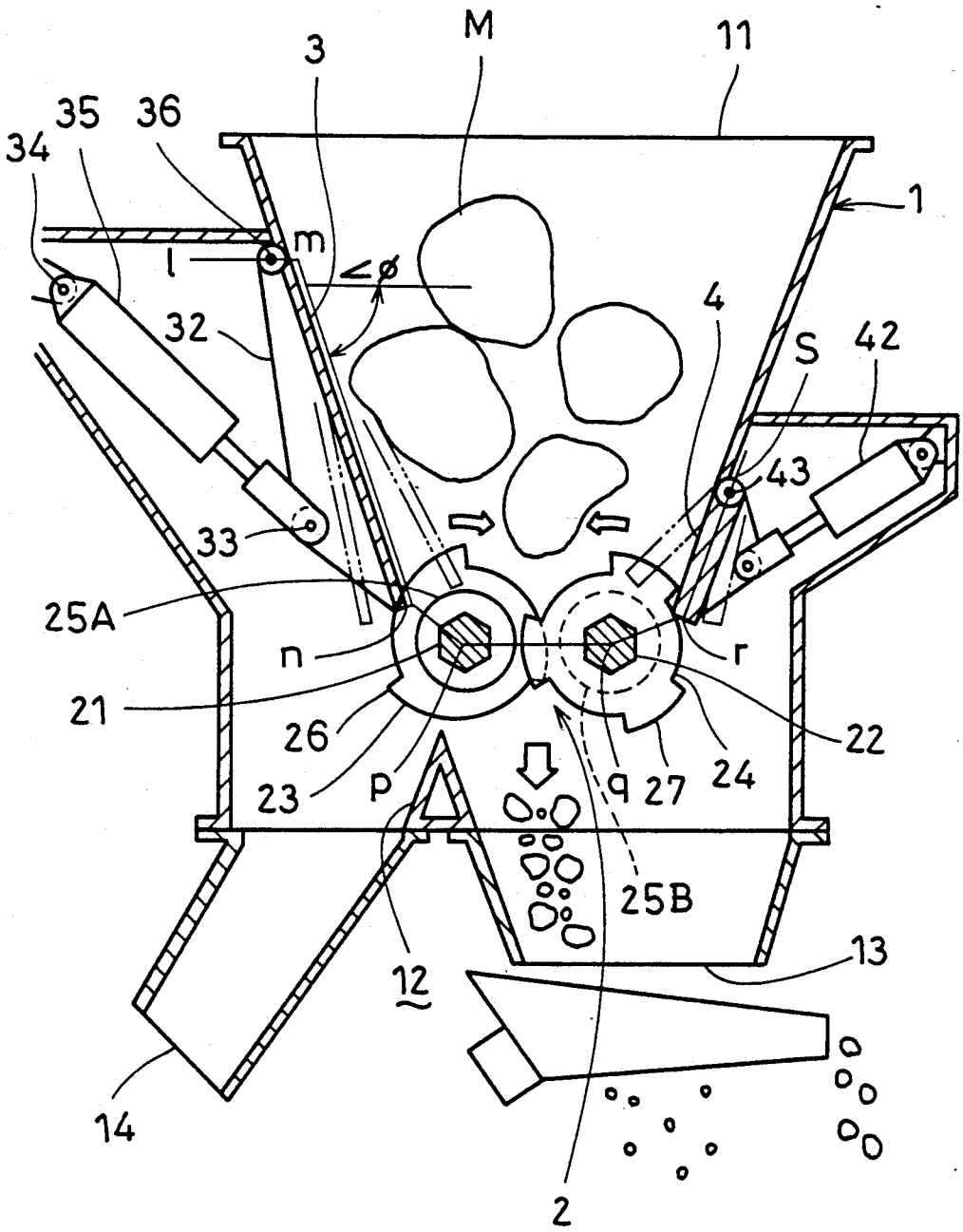
FIG. 1 is a longitudinal front view showing an embodiment (under normal state) in accordance with the present invention.

FIG. 1 is a longitudinal sectional front view showing a first embodiment of the present invention, and in which a hopper-shaped charge port 11 is provided above a casing 1, and discharge ports 13, 14 with a partition 12 therebetween are provided. A pair of rotary shafts 21, 22 are rotatably supported in the casing, and rotatable knives 23, 24 and spacer rings 25A, 25B are respectively mounted on the rotary shafts in an alternate manner, thus forming a crushing section 2. The rotational direction and frequency (rpm) of the rotary shafts 21, 22 are independently changeable. A feed plate 3 is vertically disposed from the casing at a portion obliquely above the rotatable knife 23, and a cutter 4 is also vertically disposed from the casing at a portion obliquely above the rotatable knife 24 but in an opposite direction.

Figure 2A:
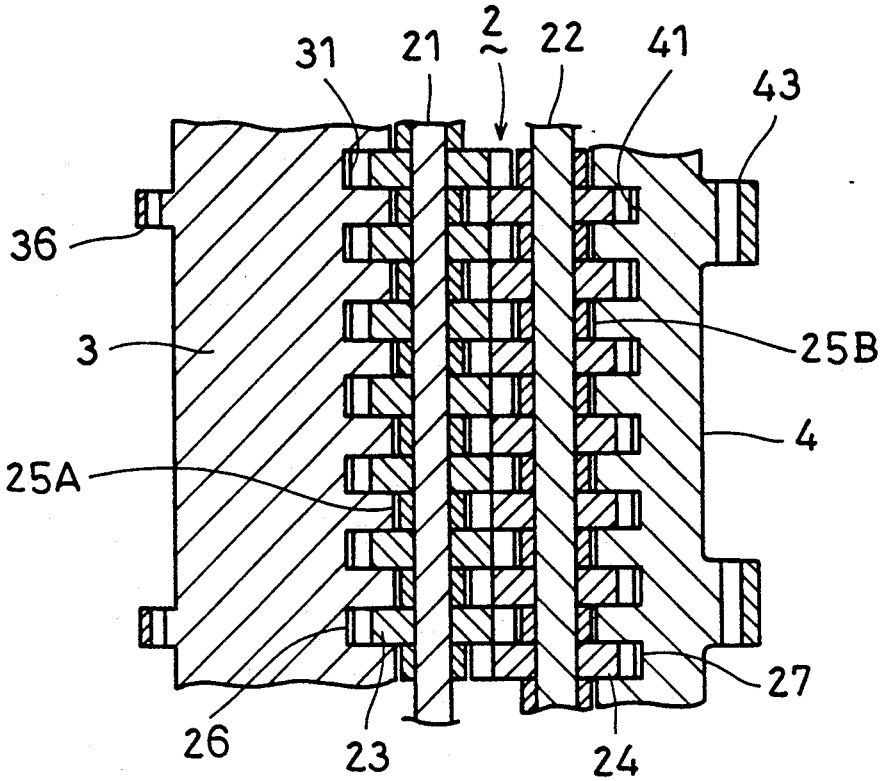
FIG. 2 (A) is a developed view taken along the line formed by the points l, m, n, p, q, r and s in FIG. 1 before abrasion.
Figure 2B:
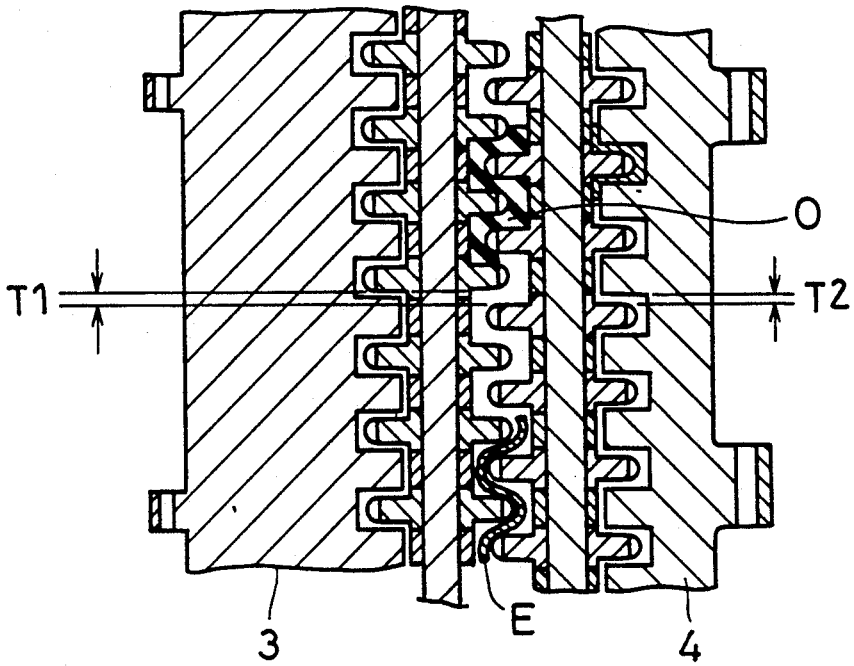

FIGS. 2(A) and 2(B) are developed views showing the feed plate 3 and the cutter 4 intersecting the rotatable knives 23, 24, and showing cutout portions 31, 41, through which the top end of the locus of each rotatable knife passes at the time of rotation of the knives. These cutout portions are provided along the full length of the knives in a comb-like manner as is shown by the line formed by the points l, m, n, p, q, r and s.

FIG. 1 and FIG. 2(A) both show a state of normal operation of the crusher, and in which an object M to be crushed such as municipal waste thrown into a charge port 11 is guided to a gap formed between the rotatable knife 23 rotating clockwise and the rotatable knife 24 rotating counterclockwise. The object M is bit and crushed or shredded shearingly into small pieces to be discharged from the discharge port 13 to the outside of the crusher. Since the partition 12 is disposed between the two knives 23, 24, the crushed waste does not move toward the discharge port 14 but is delivered to the next step.

With the lapse of a long operation time, however, abrasion of the rotatable knives 23, 24 proceeds gradually to the extent of enlarging the gap between one rotatable knife and the counter spacer ring as shown in FIG. 2(B), whereby such waste as used tire 0 or vinyl chloride E, for example, is not shearingly shredded or crushed but merely bit between the two knives and sent out as it is. Waste such as small cartridge cylinders may also pass through the gap without being sufficiently compressed or crushed because of the abraded and enlarged gap.

Figure 3:
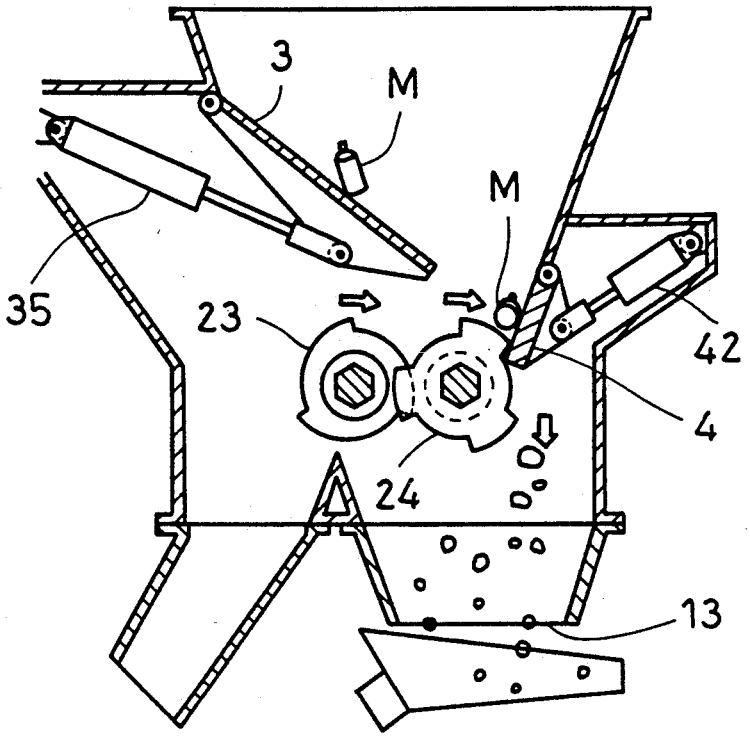
FIG. 3 is longitudinal sectional front view showing a function (of crushing relatively small materials) in accordance with the invention.

Even when the mentioned state of an enlarged gap is found, the waste can be shearingly crushed between the rotatable knives and the cutter just by setting clockwise the rotational direction of both rotary shafts 21, 22. At the same time when turning the end of the feed plate 3 upwardly to disengage the rotatable knife 23 from the cutout 31 and extending the feed plate 3 obliquely crossing the charge port as shown in FIG. 3, so as to extend above the center portion of the two rotatable knives like a hood, relatively small waste to be crushed, such as a cartridge cylinder, a spray can, come in contact with the upper face of the feed plate 3 and slidingly drops to be bitten between the cutout portions 41 of the cutter 4 and the rotatable knife 24, whereby the bitten waste is completely crushed and discharged without fail, thus solving the problem mentioned with reference to FIG. 2(B). In this respect, it is certain that not only the rotatable knives but also the cutter is exposed to the abrasion conditions, but the cutter 4 acts as a scraper during normal operation and suffers less from the abrasion, and therefore when comparing a gap T1 formed between the rotatable knives with a gap T2 formed between the rotatable knife and cutout portion, a large difference is found between the two gaps T1, T2, and this difference is increased all the more with the progress of abrasion, from which it is understood that the arrangement shown in FIG. 3 provides a peculiar technical advantage.

In the same manner, if any troublesome waste such as used a tire, vinyl bag, a fiber product like carpet or underwear, stick to or twine itself around the rotatable knives making it impossible to shearingly crush them, they are exactly crushed shearingly by the sharp edge of the cutter. Furthermore, since the collection of classified waste has become prevalent recently to a certain extent as mentioned above, a desirable advantage may be expected, if the shape and nature of the waste are preliminarily acknowledged and the arrangement shown in FIG. 3 is made to correspond to such shape and nature of the waste.

Figure 4:
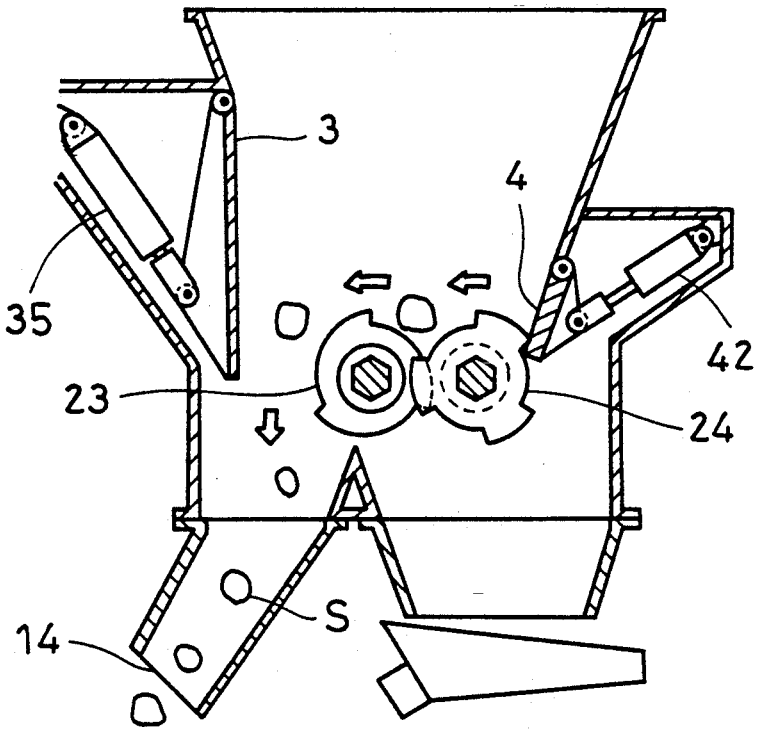
FIG. 4 is a longitudinal sectional front view showing another function (of discharging a rigid material) in accordance with the invention.

FIG. 4 shows a function of the invention performed when a highly rigid material such as steel balls which are impossible to crush is mixedly thrown in the crusher.

In such a case, both rotary shafts 21, 22 are rotated counterclockwise and the end of the feed plate 3 is turned downward so as to disengage the rotatable knife 23 from the cutout portion 31 in reverse arrangement from that shown in FIG. 3, whereby the rigid material S is guided to the left side of the crusher while rolling over the top of the rotatable knives and drops down to be selectively discharged from the discharge port 14 after being classified by the partition 12. As a result, it is now possible to protect the crusher against the problem caused by overload. In addition, the rigid material removed as mentioned above will no longer be delivered mixedly to the next process but is held to await a different disposal.

Figure 5:
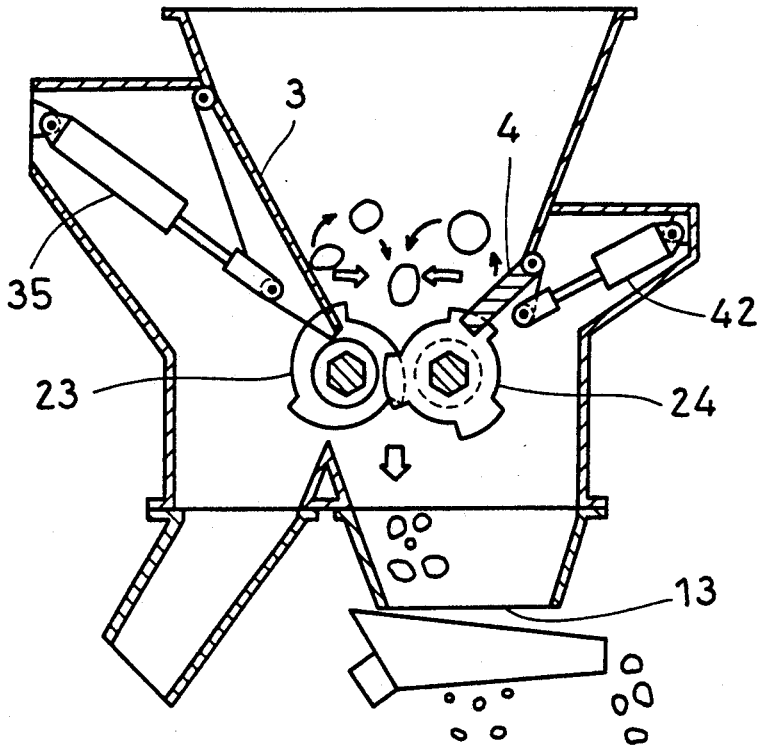
FIG. 5 is a longitudinal sectional front view showing a further function (of shaking off residue) in accordance with the invention.

FIG. 5 shows a function of the invention which is required to be performed in the event that waste thrown into the crusher is caught by a portion such as the upper corners of the rotatable knives 23, 24 beneath the charge port and retained during the normal operation shown in FIG. 1.

In the state shown in FIG. 5, when turning the feed plate 3 and the cutter 4 suddenly many times through a small angle toward the center of their rotary shafts, the retained waste is bumped off by the shocks from such sudden movements and drops down to the center portion of the engaging section to be finally crushed.

Figure 6:
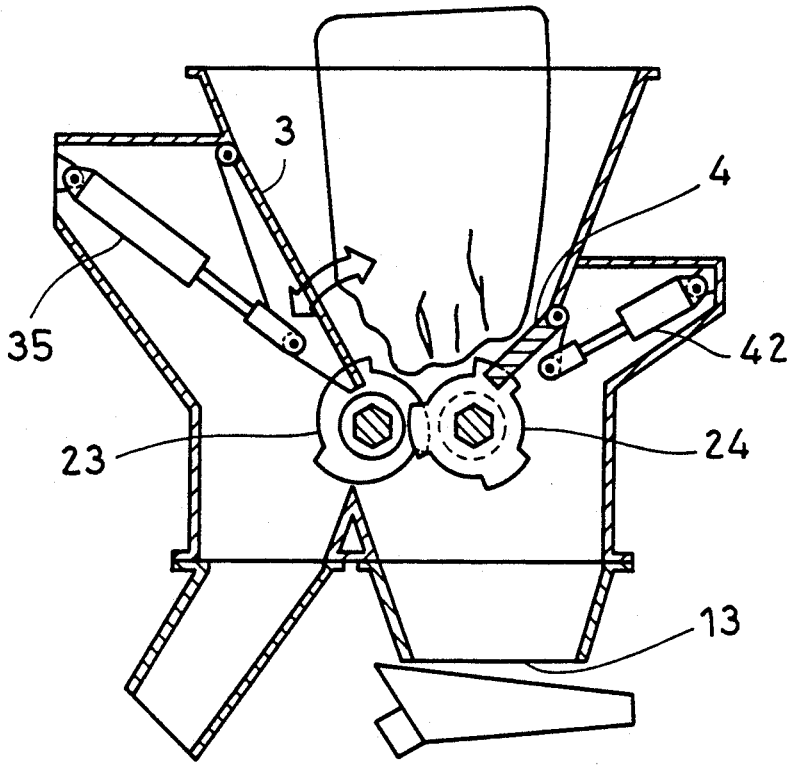
FIG. 6 is a longitudinal sectional front view showing still another function (of biting bulky waste) in accordance with the invention.

FIG. 6 shows a further function of the invention which is required to be performed when bulky waste such as a refrigerator, a washing machine or the like is longitudinally thrown in and the rotatable knives run idly. To meet this situation, it is desirable to have the feed plate suddenly vibrated to repeatedly generate shocks to one side of the bulky waste to deform it, then a part of the side near the bottom is drawn in to be easily dragged in with the cutting edge of the rotatable knives and finally crushed shearingly thereby.

Figure 7:
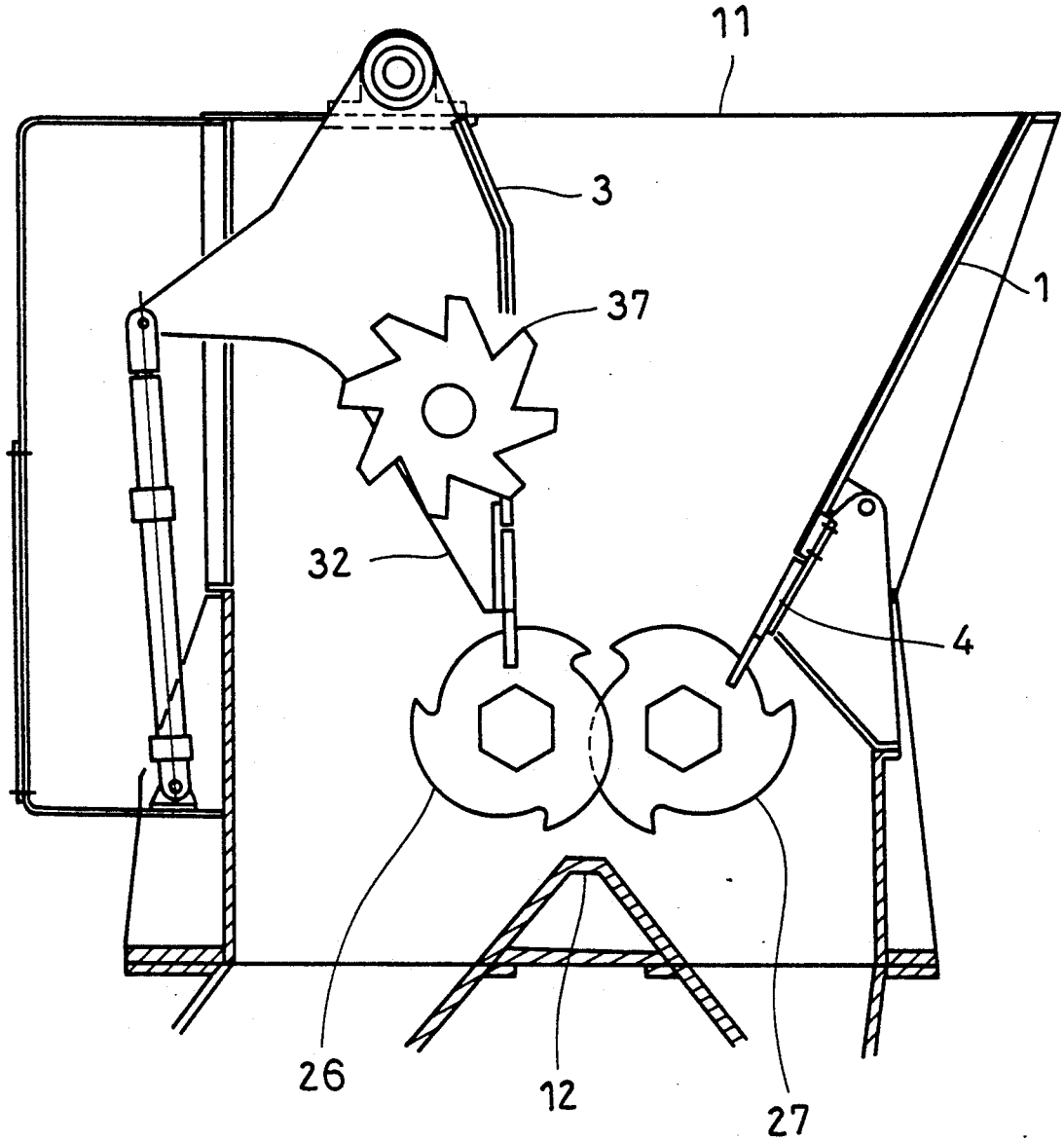
FIG. 7 is a longitudinal sectional front view showing another embodiment in accordance with the invention.

FIG. 7 shows another embodiment which is an improvement of those shown in the foregoing FIGS. 1 to 6, and in which a feed roller 37 is rotatably attached to a leg section 32 in order to perform more exactly the function described mainly with respect to FIG. 6.

Figure 8:
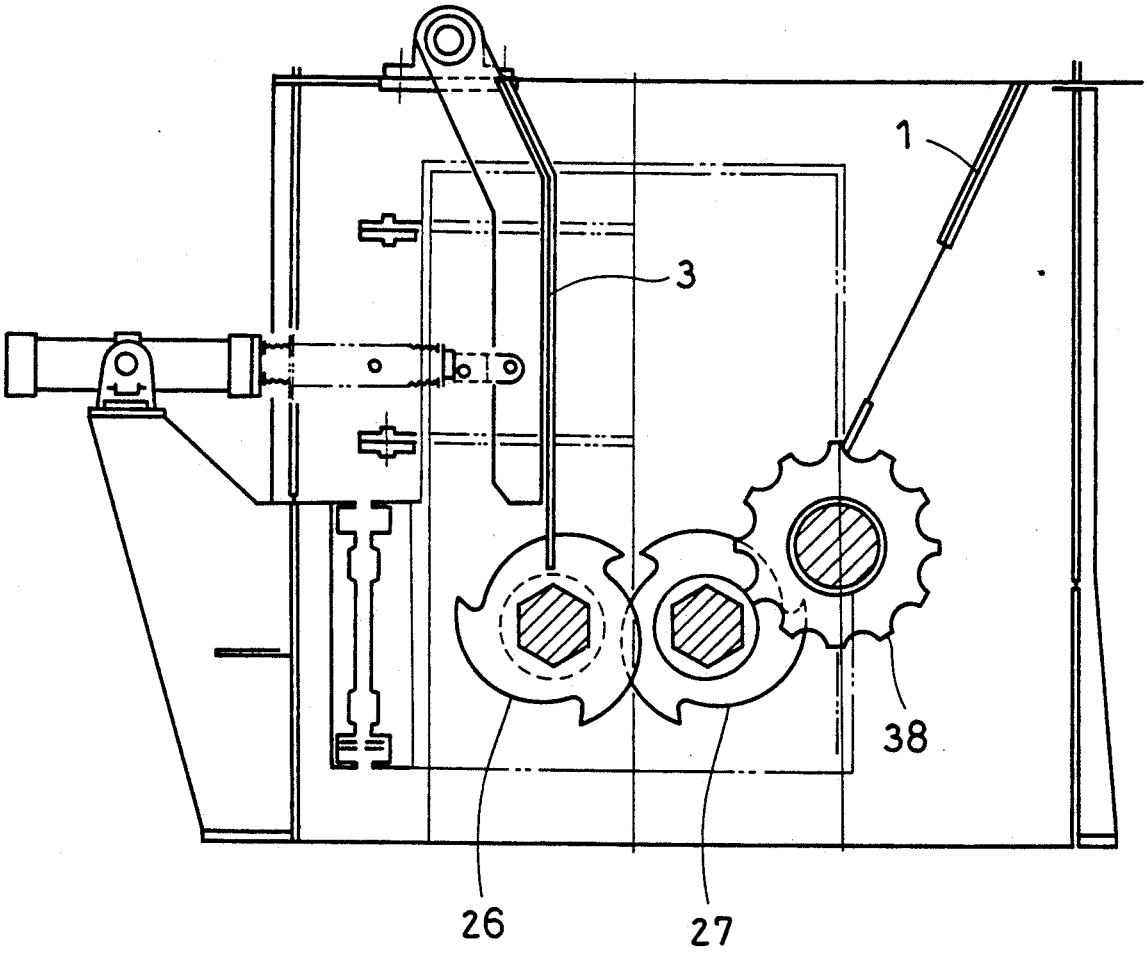
FIG. 8 is a longitudinal sectional front view showing a further embodiment in accordance with the invention.

FIG. 8 shows a further embodiment in which a feed roller 38 is rotatably attached, in place of the cutter 4 described with reference to FIG. 1, to the casing side facing the feed plate 3.

In both of the foregoing second and third embodiments, the ability to bite bulky waste between the rotatable knives for shearing is further increased by providing projections on the periphery, so that those projections may push aside of the bulky waste toward the center portion. Moreover in the case of the embodiment shown in FIG. 8, the attached feed roller 38 serves as a scrapper in the same manner as mentioned in the foregoing first embodiment. When required, it is also preferable to rotatably attach another feed roller on the upper part so as to further increase the pushing and collapsing performance.

For turning the feed plate 3, one end thereof is attached with a pin 33 to the leg section 32 provided with a back plate as shown in FIG. 1, and the other end makes use of the telescopic action of a cylinder 35 attached to the casing with a pin 34. When telescopically moving the cylinder 35, the feed plate 3 turns around a fulcrum pin 36, thus the cylinder serves as an actuator. In the same manner, for turning the cutter 4, the telescopic action of a cylinder 42 is utilized, thereby the cutter is permitted to turn around a fulcrum pin 43.

Though rotational direction of the two rotary shafts can be changed in both the forward and backward directions, when establishing a program so as to be automatically changed by combining such rotational directions and actuation of the cylinder on certain conditions, it becomes possible to achieve sufficient maintenance and crushing efficiency by computer control.

Figure 9:
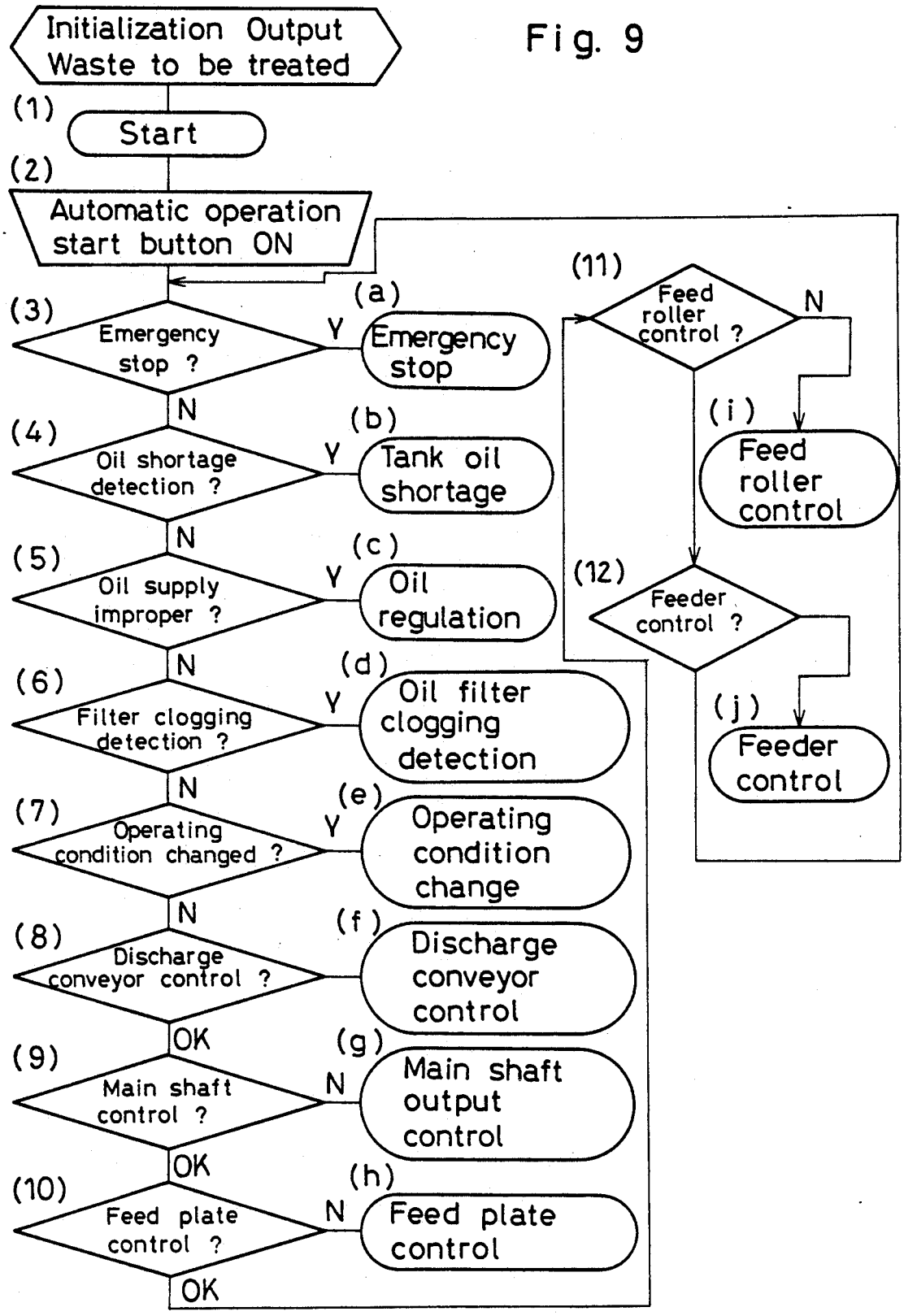
FIG. 9 is a flow chart showing in outline the control system in accordance with the invention.

FIG. 9 is a flow chart showing an outline of a control procedure for the embodiment shown in FIG. 7, and on which requirements for initialization is shown as an example hereunder:

(1) Output:

Maximum torque (TMS)=restart from the time of reverse turning (100%);

Maximum operating torque (TM) =detection of overload (95%);

Optimum rotation frequency, position and movement of feed plate, and frequency of reverse rotation after stoppage due to overload for each classified waste;

Condition of detection of foreign materials, frequency of reverse rotation, and position of feed plate;

(2) Start and stop of sequence, and procedure of emergency stop; and (3) Output of supply apparatus and conditions to be set.

Figure 10:
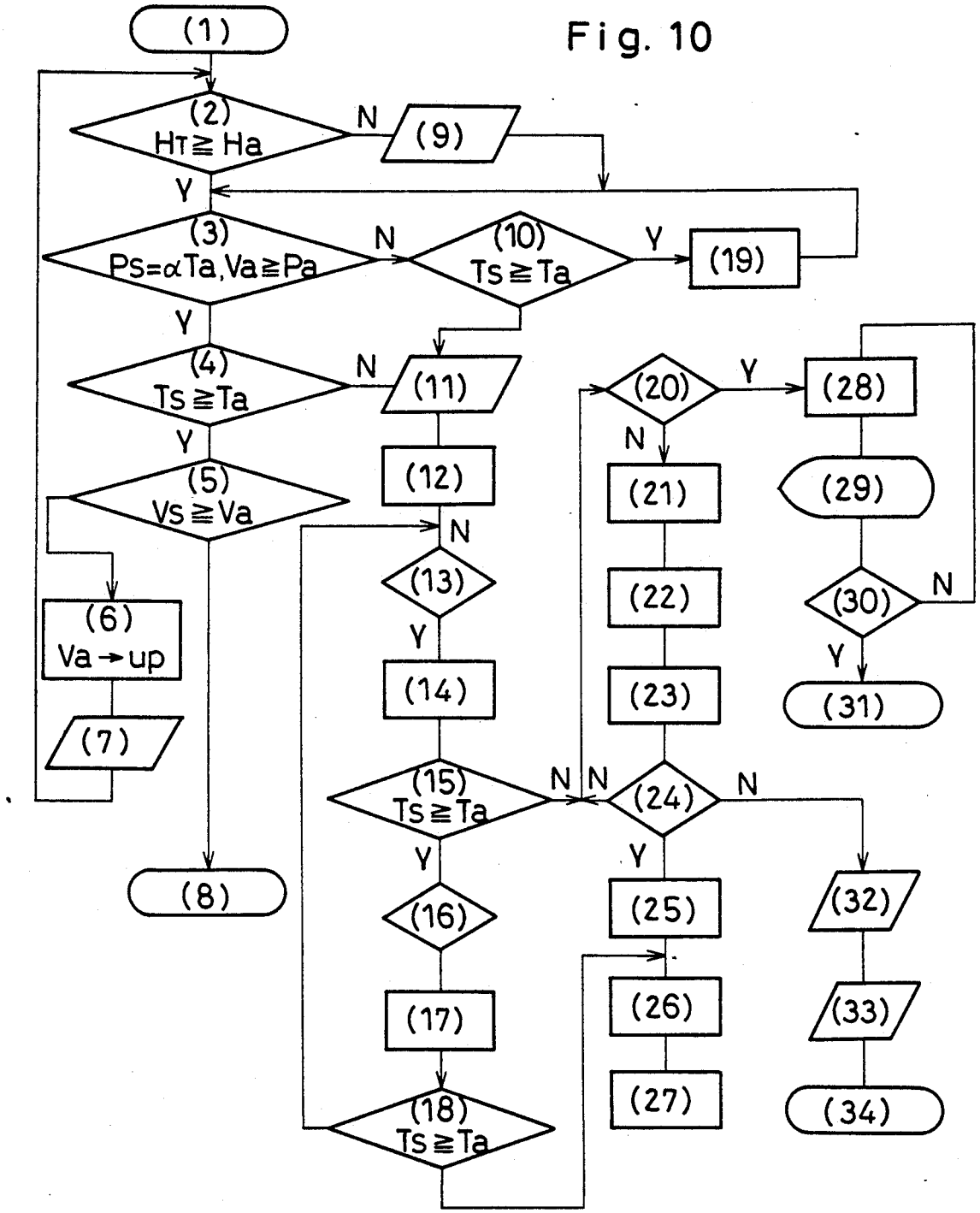
FIG. 10 is a flow chart showing a process of discharging rigid material among the controls over relative sections.

Based on the initial conditions mentioned above, controls for each section including emergency stop, oil quantity, oil temperature, oil filter, change in operating conditions, discharge conveyor, feed plate, feed roller can be set and executed. FIG. 10 shows a flow chart with respect to the detection of mixed rigid material and separate discharge thereof as a representative control, and in which Ps denotes a set output, Ts denotes a set torque, Vs denotes a set speed, Pa denotes a real output, Ta denotes a real torque, and Va denotes a real speed.

Described hereinafter are control devices and an information transmission route.

Figure 11:
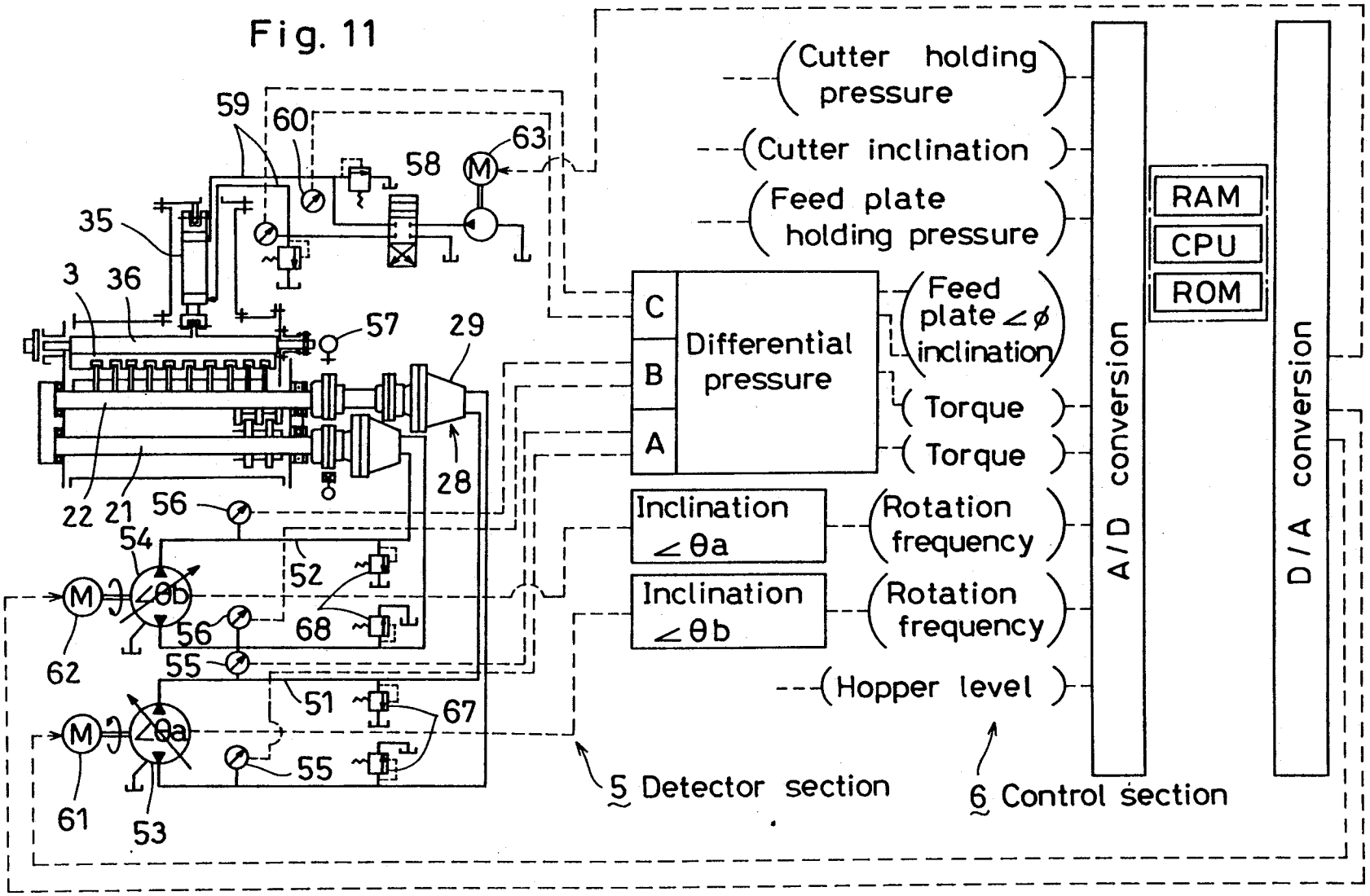
FIG. 11 shows hardware for the controls in accordance with the invention.

FIG. 11 shows an example of such control, and in which detector section 5 of the crusher for detecting the rotation frequency R comprises hydraulic motors 28, 29 for driving the rotary shafts of the crushing section, and axial piston pumps 53, 54 attached to the hydraulic pressure section by way of oil pipes 51, 52. These pumps indicate the discharge quantity and discharge direction of oil in the form of inclinations $\angle\theta a$, $\angle\theta b$ of an inclined plate in the pump. With an increasing discharge quantity, the rotation frequency of the hydraulic motors 28, 29 is also increased, and turning $\theta°$ from positive to negative results in reversal of the rotational direction.

Torque Ta applied to the rotary shafts can be recognized by checking the differential pressures A, B from oil pressure indicators 55, 56 attached to the oil pipes 51, 52. A potentiometer 57 attached to the fulcrum pin 36 detects the inclination angle of the feed plate 3. Holding pressure of the feed plate 3 is indicated by an oil pressure indicator 60 attached to an oil pipe 59 connected to the hydraulic cylinder 35 on the backside of the feed plate. Detection of the cutter 4 is performed in the same manner as the feed plate.

To operate a desired section according to instructions from the control section 6, the mentioned drive motors 28, 29, connected to the axial piston pumps 53, 54 by way of an oil pipe and the hydraulic cylinder 35 connected to a hydraulic pump 58 by way of an oil pipe, are driven.

Figure 13:
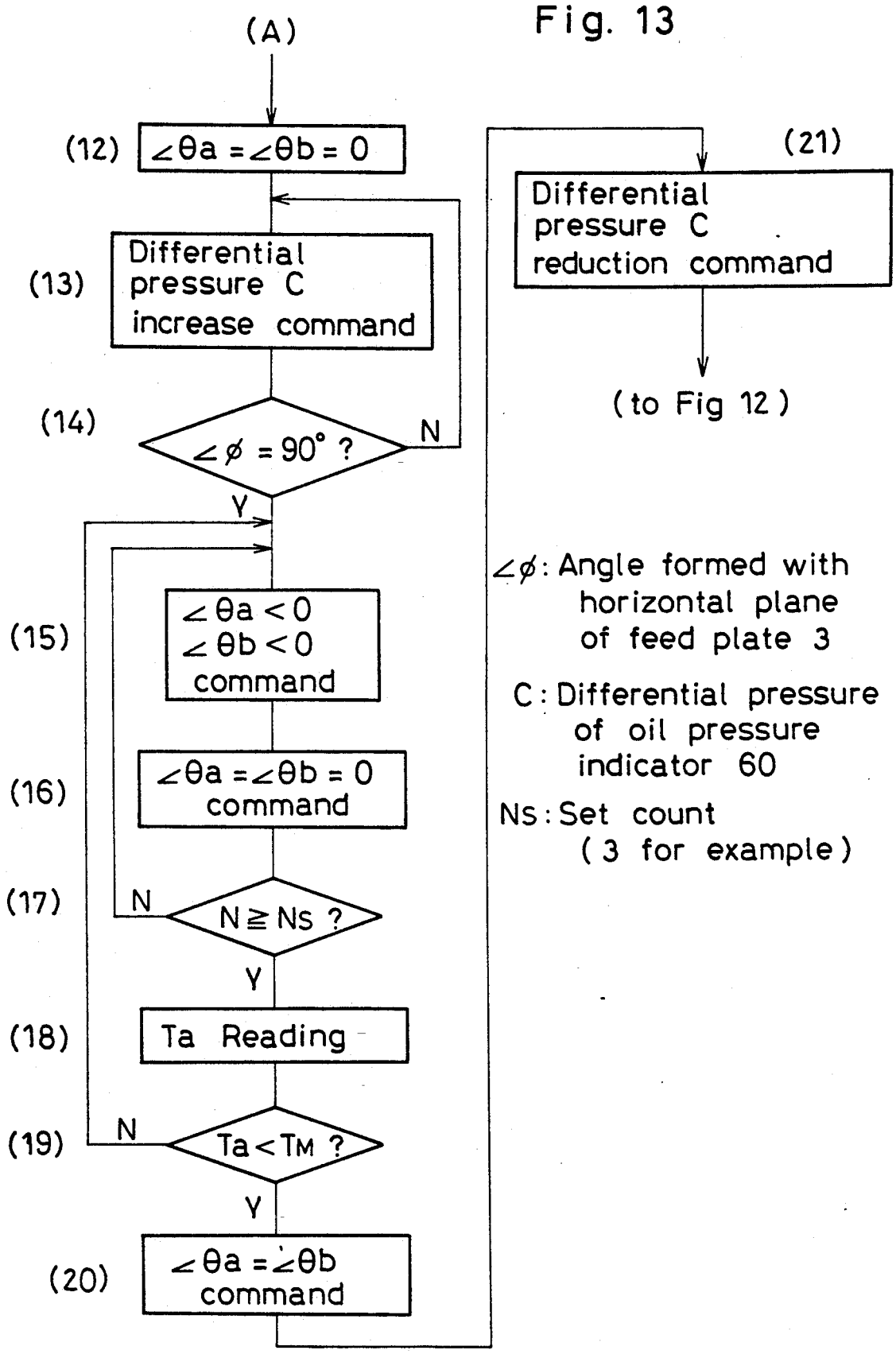
FIG. 13 is a flow chart showing the control procedure at the time that something abnormal is encountered.
Figure 14:
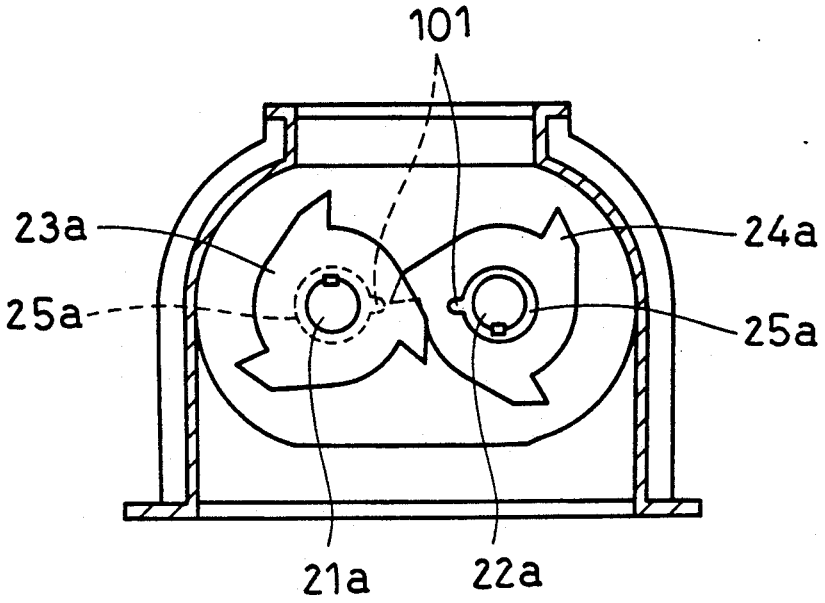
Fig. 14 Prior art
FIG. 14 is a longitudinal sectional front view showing a crusher according to the prior art.
Figure 15:
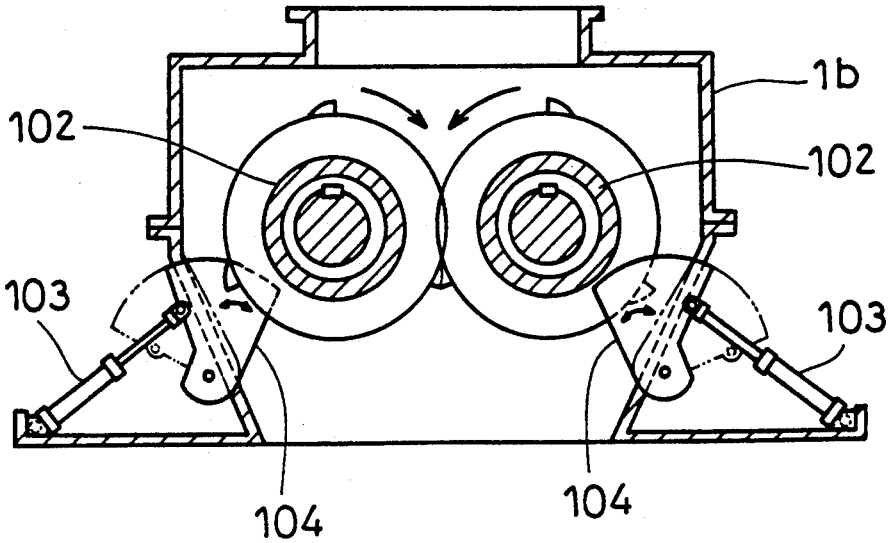
Fig. 15 Prior art
FIG. 15 is a longitudinal sectional front view showing another crusher according to the prior art.

An example of a transmission sequence of actual drive instruction in the detecting section 5 and control section 6 is described hereinafter with reference to FIG. 12 and 13.

(1) Initialization is conducted before starting the operation of the crusher. Generally, the initialization depends upon whether the material M to be crushed is bulky or not. When the material M is relatively bulky, an angle formed by inclination of the feed plate 3 is set to be large. On the other hand, when the material M is of relatively small bulk, the angle $\angle\phi$ is set to be small so that the material M to be crushed may be guided to the crossover line of the two rotary shafts, i.e., to the center portion during the crushing operation.

(2) Optimum workload W is selected among the levels classified from experience into several grades depending upon the performance of the drive motor for driving the rotary shafts, and the size, the material, the shape, the nature of the material M to be crushed including whether or not an explosive substance is mixed, though this step can be omitted so long as the conditions are fixed at all times.

(3) Reading of a real torque Ta is performed by conversion from the differential pressures A, B of the oil pressure indicators 55, 56.

(4) If the torque Ta is larger than the allowable limit Tm, it means occurrence of something abnormal, and a different process is needed. For example, it is preferred to shift the process to (A) shown in FIG. 13.

(5) When the torque Ta is within the limit, a desirable rotation frequency R is calculated from an express W=f(Ta, R). High torque results in low rotation frequency, and low torque results in high rotation frequency.

(6) Reading of a rotation frequency Ra is performed by conversion from the angles $\angle\theta a$, $\angle\theta b$ of the inclined plates of the axial piston pumps 53, 54. When the inclined plates are neutral, $\theta°$ is 0 and the rotary shafts 21, 22 are not operated. Under normal operation, if the clockwise direction is set to be positive, the counterclockwise direction becomes negative as a matter of course. Since the rotation of the two rotary shafts is a uniform rotational motion in opposite direction from each other, $\angle\theta a = -\angle\theta b$ and usually $|\theta°|$ is constant.

(7) Real workload is obtained by substituting Ta, Ra into the mentioned expression of the optimum workload W. If the workload is smaller than the allowable minimum workload Wm, it means the occurrence of something abnormal, and a different process is needed. Thus the process is to be shifted to another flow chart (B).

(8) If the workload is not smaller, Ra is compared with the allowable minimum workload Rm to inspect whether the workload is larger than Rm. When the rotation frequency is so high as to be over the limit, there is a possibility of explosion during crushing, and therefore the rotation frequency is lowered at least to Rm. And a signal is sent to the axial pamps 53, 54.

(9) to (11) To achieve a maximum workload under normal operation, a signal for coinciding the real workload Ra with R is sent to the axial pumps 53, 54. This cycle is repeated to continue a crushing operation with the best efficiency.

In this connection, the flow sheet is FIG. 13(A) shows a process in the event of mixing some rigid substance impossible to be crushed such as steel ingot and possible to cause a problem with the machine if the operation is continued.

(12) If the torque Ta is over Tm and an overload occurs, the inclinations, $\angle\theta a$, $\angle\theta b$ becomes 0, whereby the drive motors 28, 29 stop and their rotation frequency becomes 0.

(13) A signal for increasing the differential pressure C in the oil pressure indicators 60, 61 is sent to the hydraulic cylinder 35.

(14) The feed plate 3 turns around the support pin 36 until the angle $\angle\phi$ formed with a horizontal plane becomes maximum (perpendicular in this example).

(15) A signal for changing the angle of the inclined plate of the axial pump 53 is sent so that the two axial pumps 53, 54 may both be inclined at the same negative angle. In other words, the two rotary shafts 21, 22 rotate in the same direction (clockwise, for example) at the same speed, thereby removing the rigid material causing the overload.

(16), (17) After conducting a reverse rotating for a predetermined time, the rotation mentioned in (15) is stopped and again started. This operation is repeated a predetermined number of times N (three times, for example).

(18) to (21) After reading the rotation torque Ta to acknowledge that Ta is lower than Tm, the process is returned to the flow chart in FIG. 12.

In the example shown in FIG. 12(B), the waste to be crushed is so small as to escape from the crushing area thereby causing idle running, otherwise waste such as string or cloth twines itself around the rotatable knives without being shredded thereby also causing idle running and falling into a state of reduce the inclination $\phi$ formed with respect to the horizontal plane of the feed plate 3 to compensate the crushing center, whereby the crushing operation is changed so as to be performed between the shaft and the cutter. After overcoming the mentioned problem of deficient load, the process is returned to the flow shown in FIG. 12, the detailed description of which is omitted herein. The algorithm shown herein is just an example, and, as a matter of course, there are a number of other automatic control methods for various operations of maintaining optimum crushing conditions and necessary security by selecting several required input factors such as adjustment of other cutters, hopper level, holding pressure of feed plate, etc.

The rotatable shafts are entirely formed of plate-like materials and it is preferable that, as shown in FIG. 1, in the combination of the two rotatable knives, the rotatable shaft 23 is provided with a spiral projecting cutting edge 26 having a surface extending from the outer periphery toward the center on one side, while the rotatable shaft 24 is provided with a circular arc projecting cutting edge 27 having a surface extending from the outer periphery toward the center on two sides.

The number of engagements of the mentioned projecting edges is a product of the number of each projecting cutting edge and rotation frequency if the two rotary shafts have been set to rotate at the same rotation frequency. However, if the rotation frequency of a pair of rotary shafts are set to be different from each other, then the number of engagements of the projecting cutting edges is a product of number of respective projecting edges and rotation frequency. Accordingly, it is possible to use properly this relation of number of engagement depending upon whether crushing of a waste is easy or difficult.

As various different embodiments of the invention may be made without departing rom the spirit and scope thereof, it is to be understood that the invention is not limited to th specific embodiments thereof except as defined in the appended claims.

What is claimed is:

1. A rotor shearing type crusher, comprising:

a casing having a hopper-shaped or crushed and a discharge port at its other end for discharging sheared or crushed waste, and a partition portion associated with said discharge port;

two shafts rotatably mounted to the casing between the charge port and the discharge port, said shafts being mounted parallel to each other;

a plurality of knives and spacer rings arranged in alternating fashion along each of said shafts for rotation with their respective shafts, said plurality of knives and spacer rings being arranged on each shaft such that the cutting edges of the knives on one shaft move past the spacer rings on the other shaft;

a feed plate pivotably mounted to said casing above the knives and spacer rings mounted on one of said shafts; and a cutter pivotably mounted to said casing above the knives and spacer rings mounted on the other of said shafts, wherein:

said discharge port is divided in two by said partition portion of said casing, said partition portion being situated downstream of said knives and spacer rings on said shafts, the feed plate and cutter have a length corresponding to the length of said shafts and are each provided with cutouts arranged along the length of the respective feed plate and cutter in a comb-like manner such that the cutting edges of the knives mounted on said one shaft pass through the cutouts of the feed plate and the cutting edges of the knives mounted on said other shaft pass through the cutouts of the cutter;

both the feed plate and cutter are independently rotatable; and the rotational direction and speed of each shaft are independent of each other.

2. The rotor shearing type crusher as defined in claim 1, further comprising:

a cylinder mounted at one end to said casing and connected at its other end to said feed plate for pivotably moving said feed plate;

a further cylinder mounted at one end to said casing and connected at its other end to said cutter for pivotably moving said cutter.

3. The rotor shearing type crusher as defined in claim 2, further comprising:

the knives on said one shaft include a plurality of plate-like projections each defining a cutting edge extending from the outer periphery of the knife toward the center of the knife on two sides of the projection.

4. The rotor shearing type crusher as defined in claim 1, further comprising:

a feed roller rotatably mounted to said feed plate, said feed roller having a plurality of projections extending outwardly from its periphery.

5. The rotor shearing type crusher as defined in claim 4, further comprising:

the knives on said one shaft include a plurality of plate-like projections each defining a cutting edge extending from the outer periphery of the knife toward the center of the knife on one side of the projection; and the knives on said other shaft include a plurality of plate-like projections each defining a cutting edge extending from the outer periphery of the knife toward the center of the knife on two sides of the projection.

6. The rotor shearing type crusher as defined in claim 1, further wherein:

the knives on said one shaft include a plurality of plate-like projections each defining a cutting edge extending from the outer periphery of the knife toward the center of the knife on one side of the projection; and the knives on said other shaft include a plurality of plate-like projections each defining a cutting edge extending from the outer periphery of the knife toward the center of the knife on two sides of the projection.

7. The rotor shearing type crusher as defined in claim 1, further comprising:

detecting means operatively associated with each shaft for detecting the torque and rotary speed of each shaft and generating signals indicative thereof;

further detecting means operatively associated with said feed plate for detecting the inclined position and the holding pressure of the feed plate and generating signals indicative thereof; and control means for receiving the generated signals from said detecting means and said further detecting means, processing said signals, and generating control signals for controlling the operation of the crusher and for separately discharging foreign material after the drive of said shafts is suspended.

8. The rotor shearing type crusher as defined in claim 7, further wherein:

said detecting means includes an axial piston pump connected to a hydraulic motor associate with each shaft;

the rotation speed of each shaft is a function of the angle of an inclined plate in its associated axial piston pump; and the torque on each said shaft is a function of the differential pressure between the input and output of its associated hydraulic motor.

9. A rotor shearing type crusher, comprising:

a casing having a hopper-shaped charge port at one end for receiving waste to be sheared or crushed and a discharge port at its other end for discharging sheared or crushed waste, and a partition portion associated with said discharge port;

two shafts rotatably mounted to the casing between the charge port and the discharge port, said shafts being mounted parallel to each other;

a plurality of knives and spacer rings arranged in alternating fashion along each of said shafts for rotation with their respective shafts, said plurality of knives and spacer rings being arranged on each shaft such that the cutting edges of the knives on one shaft move past the spacer rings on the other shaft;

a feed plate pivotably mounted to said casing above the knives and spacer rings mounted on one of said shafts; and a feed roller rotatably mounted to said casing and facing said feed plate, said feed roller having a plurality of projections extending outwardly from its periphery, wherein:

said discharge port is divided in two by said partition portion of said casing, said partition portion being situated downstream of said knives and spacer rings on said shafts;

the feed plate having a length corresponding to the length of said shafts and being provided with cutouts arranged along its length in a comb-like manner such that the cutting edges of the knives mounted on said one shaft pass through the cutouts of the feed plate;

both the feed plate and feed roller are independently rotatable; and the rotational direction and speed of each shaft are independent of each other.

* * * * *